US007043795B2

(12) United States Patent
Bosgoed

(10) Patent No.: US 7,043,795 B2
(45) Date of Patent: May 16, 2006

(54) CONNECTING MEMBER FOR CURTAIN RAILS

(75) Inventor: Henricus Wilhelmus Frederikus Bosgoed, Schalkhaar (NL)

(73) Assignee: Forest Group Nederland B.V., Deventer (NL)

( * ) Notice: Subject to any disclaimer, the term of this patent is extended or adjusted under 35 U.S.C. 154(b) by 173 days.

(21) Appl. No.: 10/451,838

(22) PCT Filed: Jan. 24, 2002

(86) PCT No.: PCT/NL02/00056

§ 371 (c)(1),
(2), (4) Date: Oct. 22, 2003

(87) PCT Pub. No.: WO02/058520

PCT Pub. Date: Aug. 1, 2002

(65) Prior Publication Data

US 2004/0067097 A1 Apr. 8, 2004

(30) Foreign Application Priority Data

Jan. 26, 2001 (NL) ..... 1017200

(51) Int. Cl.
*A47H 1/04* (2006.01)

(52) U.S. Cl. ..... 16/211; 16/95 D; 16/96 D

(58) Field of Classification Search ..... 16/211, 16/93 D, 94 D, 95 D, 96 D, 87.4 R, 95 R, 16/96 R, 87.2, 94 R; 211/105.1, 105.3; 403/292–294
See application file for complete search history.

(56) References Cited

U.S. PATENT DOCUMENTS

| | | | | | |
|---|---|---|---|---|---|
| 3,222,095 | A | * | 12/1965 | Gerus | 403/104 |
| 3,453,011 | A | * | 7/1969 | Meinunger | 403/104 |
| 3,671,062 | A | * | 6/1972 | Ashworth | 403/292 |
| 3,987,904 | A | * | 10/1976 | Height et al. | 211/105.1 |
| 4,299,008 | A | * | 11/1981 | Burns | 16/95 D |
| 5,112,157 | A | * | 5/1992 | Haarer | 403/292 |

* cited by examiner

*Primary Examiner*—Chuck Y. Mah
*Assistant Examiner*—Michael J. Kyle
(74) *Attorney, Agent, or Firm*—Ladas and Parry LLP

(57) ABSTRACT

The invention relates to a connector element to be used with curtain rails having a substantially inverted U-shaped cross-section with its legs being flanged inwards, said flanged legs at the bottom defining a longitudinal extending opening at both sides limited by raised supporting edges formed by the extremities of the flanged legs, for supporting curtain sliders. The connector element provides for a coupling of subsequent lengths of curtain rail in which it is provided for that at the transition, the curtain sliders project beyond the supporting edge and are forced to the middle, as a result of which the otherwise occurring shocking movement at the transition between abutting extremities of lengths of curtain rail is prevented.

15 Claims, 4 Drawing Sheets

CONNECTING MEMBER FOR CURTAIN RAILS

The present invention relates to a connector element for curtain rails having a substantially inverted U-shaped cross-section having its legs flanged inwards, said flanged legs at the bottom defining a longitudinally extending opening being limited at both sides by the raised supporting edges for supporting curtain sliders, said supporting edges being formed by the extremities of the flanged legs.

Connector elements for mutually coupling subsequent lengths of curtain rail are known per se and comprise e.g. a suitable sleeve that can be slid around the extremities of subsequent curtain rails. The problem occurring here is that there will always be a larger or smaller interruption at the transition between curtain rails. In case of curtain rails with extremities being not completely straight, which can easily arise when shortening lengths of curtain rail by hand, this problem is even considerably greater than when lengths of curtain rail, shortened in the factory, are contacted at their extremities. All these transitions have the consequence that the way of the sliders passing the transition will be disturbed and that the sliding movement will repeatedly experience an abrupt vertical component. On closing and opening of the curtains, this will result in a clearly notable and disturbing shocking movement when a slider passes a transition, which will finally lead to damages, especially if additionally heavy curtain materials have been used. The damage can occur at the rail, the connection of the rail to ceiling or wall, the curtain sliders, the curtain hooks and the fastening of the curtain hooks to the curtain material.

The object of the invention is to provide for a connector element for curtain rails by which the stated problem at the transition between subsequent parts of a curtain rail can be overcome. Accordingly, according to the invention it is provided for, that the connector element consists of at least one longitudinal part or comprises at least one longitudinal part which is formed in such a way that it can be incorporated at least partly between a raised supporting edge and an outer leg of the curtain rail, the longitudinal part of the connector element having at one or more locations a height course from below a supporting edge to above said supporting edge and back.

Through this, it is achieved that a slider slides above the actual point of contact of subsequent parts of a curtain rail across the longitudinal parts of the connector element and that the otherwise occurring shocking movement is prevented. Here, the longitudinal parts have a sufficiently large length and a correspondingly gradual course as a result of which the transition from a supporting edge to a longitudinal part and reverse, and the accompanying vertical course on opening and closing of a curtain is not noticeable. This practically excludes the occurrence of any damage in passing such a transition.

According to a further elaboration, it is preferably provided for, that at least one longitudinal part of the connector element incorporated between raised supporting edge and an outer leg has an extension across the supporting edge leading to at least over the longitudinally extending opening between the raised supporting edges.

This provision also prevents that the interruption between subsequent lengths of a curtain rail can be felt by a slider abutting the side of a raised supporting edge when closing and opening a curtain. These transitions are noticeable in particular at a transition between subsequent longitudinal parts immediately preceding or following a bend in which sliders can come in tight contact against a raised supporting edge.

The connector element can consist of loose longitudinal parts that can be separatly inserted in the curtain rail ends. Further, means for preventing sliding within the curtain rail, which can consist of e.g. complementary parts of a pin and hole or a snap fitting system fitted to connector element and curtain rail.

When using a sufficiently flexible plastic it is also possible to produce longitudinal parts which can be inserted across the complete length of the curtain rail. In such an embodiment, the sliders are carried by the longitudinal parts across the entire length. Then, the extensions to beyond the supporting edges of the curtain rail should also extend across the full length, since it is hard to determine beforehand where exactly the connecting points between subsequent parts of a curtain rail will be situated.

However, it is preferred to provide a separate connector element for each connecting point in the curtain rail, said connector element comprising two longitudinal parts as well as a connecting member connecting the longitudinal parts to one another. By further providing for, that the connecting member, in cross-section perpendicular to said longitudinal parts, has a shape following at least partly the shape of the curtain rail seen in cross-section, the connector element can have an external appearance completely corresponding to the curtain rail.

Further, it is also preferably provided for, that the connecting member is provided with fastening parts which can be inserted fittingly and/or clampingly between the legs or other parts of the curtain rail. In an embodiment of the connector element, which is intended to be used in combination with a curtain rail having its top provided with longitudinal grooves pointing in opposite directions for receiving parts of an extremity of a curtain support, it has been provided for that the connecting member has at least one fastening part extending in the direction of the longitudinal parts, said fastening part having such a shape that it can be slid into the longitudinal grooves at the top of the curtain rail from the side. This embodiment yields a particularly good enclosure of the connector element within the rail, in which it will also automatically end up in the proper position.

With a connector element according to the invention with which the transitions between subsequent longitudinal parts of a curtain rail can be passed unnoticed and which corresponds completely to the curtain rail at the outside or the viewable side, it is very easy to set up a modular curtain rail system. Such a system can consist of a number of standard lengths of curtain rail, a number of standard bends, wall and ceiling supports and connector elements according to the invention. Thus, the do-it-yourselfer will be able to mount a curtain rail without any special bending tools with a quality corresponding to a professionally mounted curtain rail.

Further, the invention also provides for a curtain rail, that can be used in combination with one or more of the embodiments of the connector element, in which at the inner side of the curtain rail above the space between the raised supporting edge and an outer leg there is an inwardly protruding rib extending across at least a part of the length of the curtain rail. Through this, it is achieved that at least a part of a longitudinal part of a connector element provided in the curtain rail is enclosed between an outer leg, a raised supporting edge, the transition between them, and an inwardly protruding rib.

The invention is further explained by way of the example illustrated in the drawing, in which.

Figure 1:
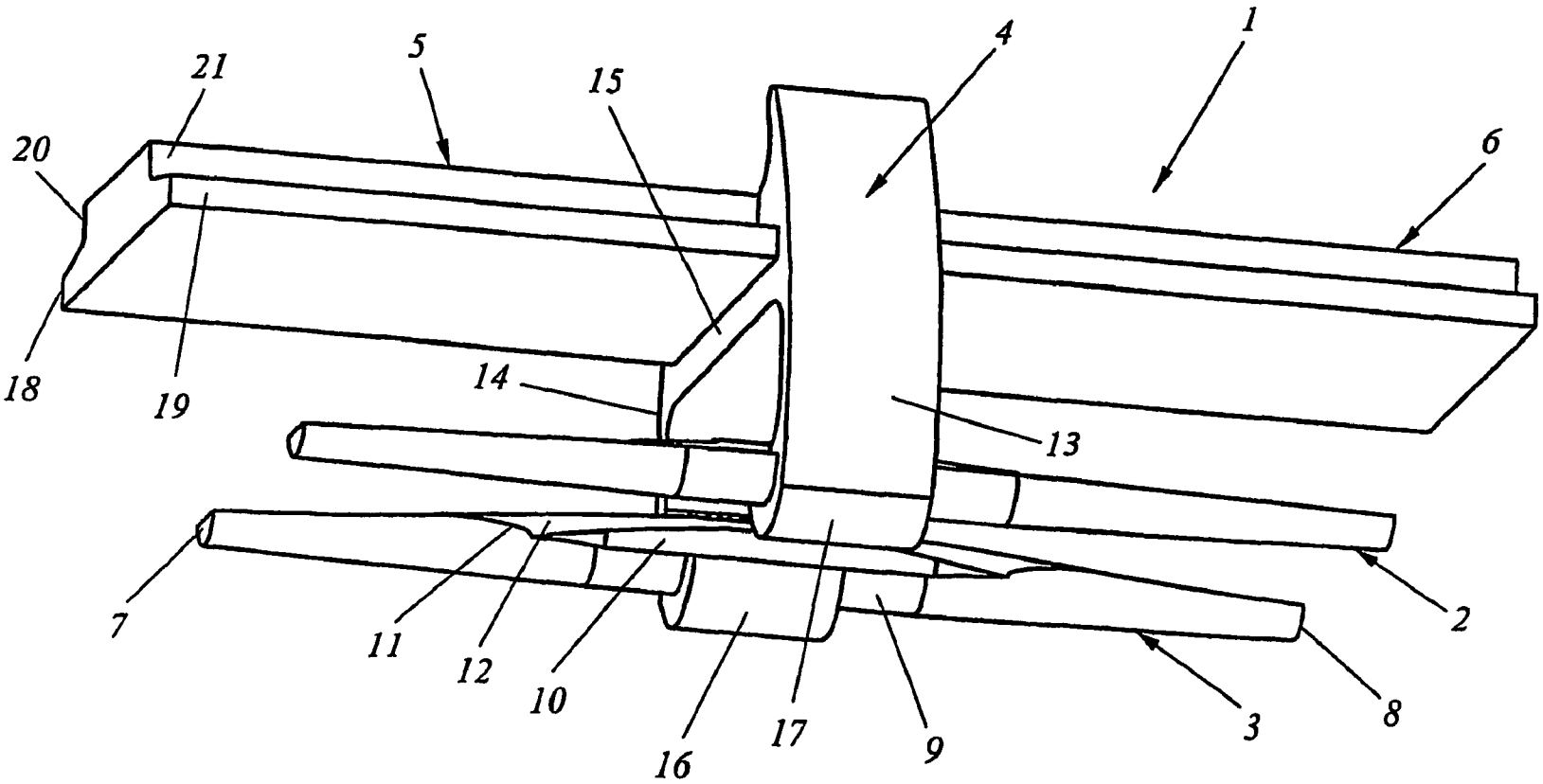
FIG. 1 shows a perspective view of a connector element.

The connector element 1 in FIG. 1 is mainly comprised of two longitudinal parts 2, 3, and a connecting member 4 having fastening parts 5, 6. At its extremities 7, 8, a longitudinal part 2, 3 has a minimum height, increasing from there to a maximum height at the middle part 9. In the middle part 9, the longitudinal parts 2, 3 have an extension 10 extending in inward direction and protruding beyond a supporting edge 35, 36 at a curtain rail 22, 23, see FIG. 4.

The extension 10 begins where the longitudinal part 2, 3 has come up to a height above a supporting edge 35, 36 and runs from there in inward direction with a gradually tapering edge 11. There, top plane 12 of the extension 10 also slants in inward direction, the slope being greater at the extremities than in the middle part where the longitudinal parts 2, 3 have the greatest height. The full course of the longitudinal parts 2, 3 and the extension 10 are directed to obtain a course of the curtain sliders which will be as gradually and unnoticeable as possible. An optimum guide is obtained if a slider having an at least somewhat curved sliding surface is employed. Here, it makes no difference whether or not the slider will be pulled slightly oblique with the curtain, the slider will always be moved up from the supporting edges 35, 36 and towards the middle and be led back to the supporting edges 35, 36.

The connecting member 4 has sides 13, 14 corresponding in shape to the outer legs 28, 29 of a curtain rail 22, 23 with which connector element 1 can be employed. It is obvious that for all forms of curtain rails it is possible to produce a connector element having an exactly corresponding outer side. The sides 13, 14 are connected to a connecting part 15 which will abut a corresponding top plane 34 of a curtain rail 22, 23. At their bottoms, the sides 13, 14 have a flanged taper 16, 17 corresponding to the taper 32, 33 of an outer leg 28, 29 of a curtain rail 22, 23 towards an outer supporting edge 35, 36.

The fastening parts 5, 6 mounted at the top of the fastening member 4 have laterally projecting edge parts 18, 19 intended to be inserted in longitudinal grooves 24, 25 in the top of a curtain rail 22, 23. These longitudinal grooves 24, 25 are intended for receiving parts of an extremity of e.g. a wall support. Then, the sides 20, 21 will abut ribs 26, 27 limiting the longitudinal grooves 24, 25.

Figure 2:
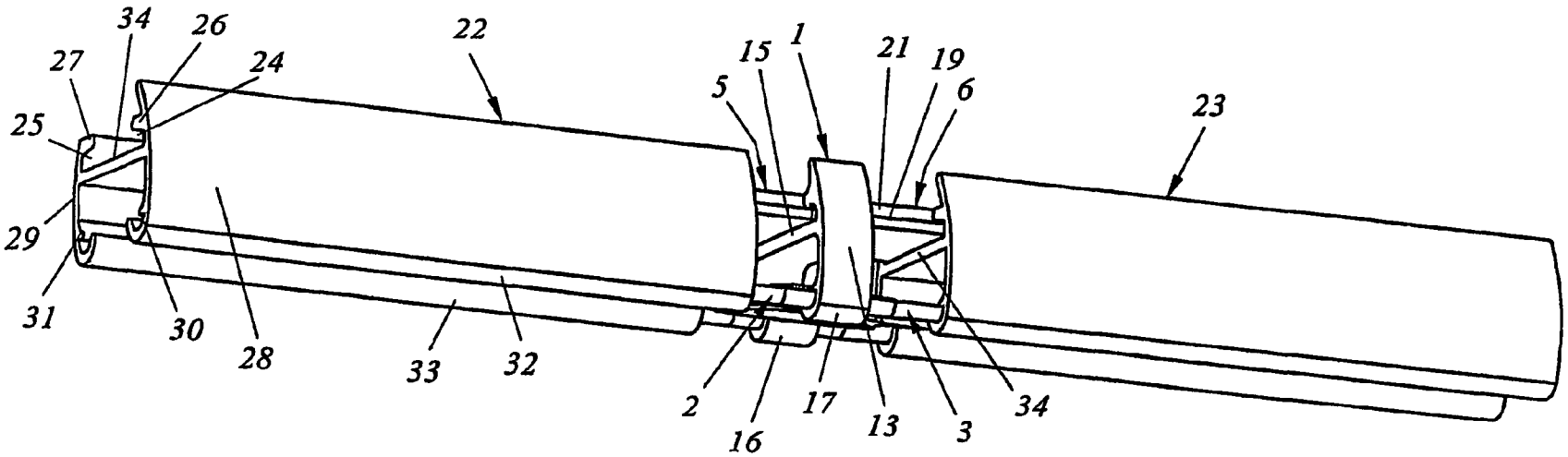
FIG. 2 shows a perspective view from below of a connector element being partly inserted in the extremities of subsequent parts of curtain rail.

In FIG. 2, connector element 1 and two lengths of curtain rail 22, 23 are partly slid into each other. Here, the longitudinal parts 2, 3 have been inserted into the space between outer legs 28, 29, ribs 30, 31 and raised supporting edges 35, 36, and the fastening parts 5, 6 with the edge parts 18, 19 have been inserted in the longitudinal grooves 24, 25. With a completely fitted assembly, the sides 13, 14 of the connector element 1 will connect to the sides 28, 29 of the curtain rail 22, 23 and the transitions 16, 17 will connect to the corresponding transitions 32, 33 of the curtain rail 22, 23.

Figure 3:
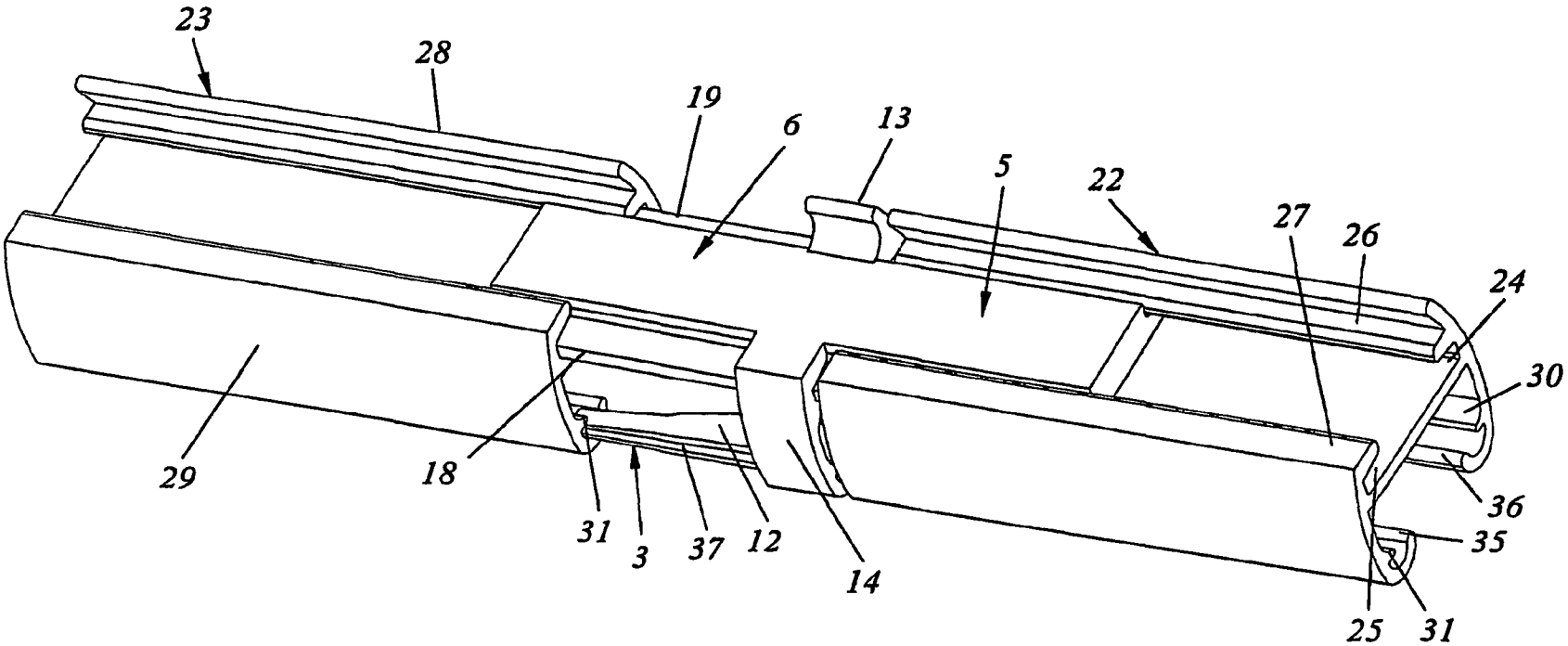
FIG. 3 shows a perspective view from above of a connector element being partly inserted in the extremities of subsequent parts of curtain rail.

In FIG. 3, a similarly fitted assembly of connector element 1 and lengths of curtain rail 22, 23 is illustrated, be it from the other side and from above. Here, the longitudinal part 3 has just been inserted in the space between raised supporting edge 35, the outer leg 29 and the rib 31. The longitudinal part 3 has a longitudinally extending recess 37 where the rib 31 will abut the longitudinal part 3 and which will provide a further enclosure of the connector element 1.

In this Figure it can further be seen that the sides 13, 14 of the connector element 1 follow the sides 28, 29 of the curtain rail 22, 23 so that there won't be any disturbance of the appearance. The side 28 continues in order to keep a wall support to be snapped into the longitudinal grooves 24, 25 largely from view.

Figure 4:
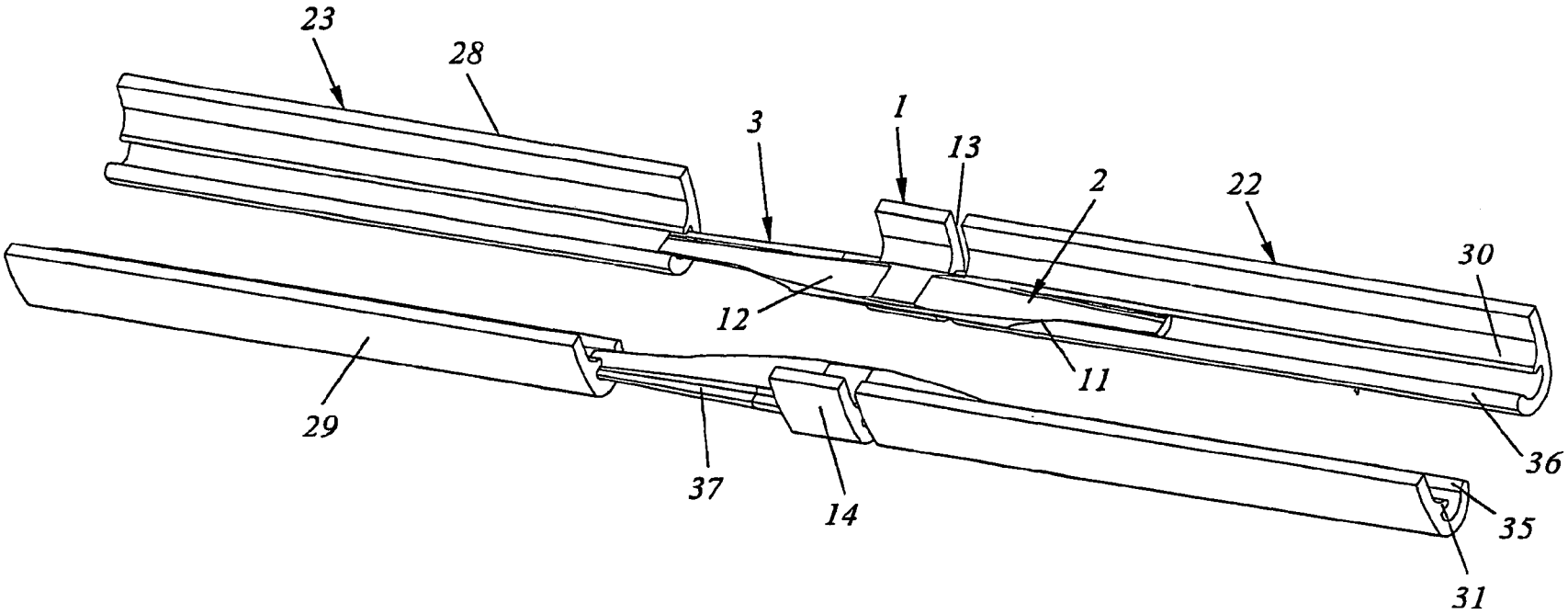
FIG. 4 shows a perspective view of a connector element with subsequent parts of a curtain rail, with the top of the assembly being cut away.

In the cut-away assembly of connector element 1 and curtain rails 22, 23 according to FIG. 4, the transition from longitudinal part 2 is clearly visible from behind the supporting edge 36 through line 11 to beyond the supporting edge 36. It will be obvious that at the transition according to line 11, the longitudinal part will project beyond the height of the supporting edge 36.

The invention claimed is:

1. Connector element for curtain rails having a substantially inverted U-shaped cross-section having its legs flanged inwards, said flanged legs at the bottom defining a longitudinally extending opening being limited at both sides by raised supporting edges for supporting curtain sliders, said supporting edges being formed by extremities of the flanged legs, said connector element further comprising at least one longitudinal part which is formed such that it can be incorporated at least partly between a said raised supporting edge and an outer said leg, said at least one longitudinal part of the connector element having at one or more locations a height course extending from below said supporting edge to above said supporting edge and back.

2. Connector element according to claim 1, wherein said at least one longitudinal part of the connector element incorporated between the raised supporting edge and the outer leg has across part of its height an extension across the supporting edge extending to at least above the longitudinally extending opening between the raised supporting edges.

3. Connector element according to claim 2, wherein the extension has at least partly a slope in a direction of the longitudinally extending opening between the raised supporting edges.

4. Connector element according to claim 1, wherein the connector element is provided with means for preventing it from sliding within the curtain rail.

5. Connector element according to claim 1, wherein the connector element and curtain rail are provided with complementary fastening means.

6. Connector element according to claim 1, wherein the connector element comprises two longitudinal parts and a connecting member connecting said longitudinal parts to one another.

7. Connector element according to claim 6, wherein the connector element, in a cross-section perpendicular to said longitudinal parts, has a shape following at least partly the shape of the curtain rail seen in cross-section.

8. Connector element according to claim 6, wherein the connecting member is provided with fastening parts which can be inserted between the legs or other parts of the curtain rail.

9. Connector element according to claim 6, wherein the connecting member is provided with fastening parts between which at least a part of the curtain rail can be inserted.

10. Connector element according to claim 6, intended to be used in combination with a curtain rail having its top provided with longitudinal grooves pointing in opposite directions for receiving parts of an extremity of a curtain support, wherein the connecting member is provided with at least one fastening part extending in the direction of the longitudinal parts, said fastening part having such a shape that it can be slid into the longitudinal grooves from the side.

11. Curtain rail to be used in conjunction with a connector element according to claim 1, wherein at an inner side of the curtain rail above the space between the raised supporting edge and an outer said leg, there is an inwardly protruding rib which extends across at least a part of the length of the curtain rail.

12. Connector element for connecting curtain rails, the curtain rails being hollow longitudinally extending guide rails for curtain gliders having a substantially inverted U-shape cross-section with a downwardly open and longitudinally extending slot, the slot being limited at both sides by raised supporting edges for supporting the curtain gliders, said connector element comprising a body member adapted to extend transversely between successive curtain rails and providing passage for the curtain gliders, a securing member extending longitudinally from both sides of the body member in a longitudinal direction of the successive curtain rails for securing the connector element to the curtain rails, longitutindal guiding portions having guiding surfaces extending at both sides of the body member in the longitudinal direction of the curtain rails, said guiding surfaces of the longitudinal guiding portions running from a lower postion at the outer ends of the longitudinal guiding portions to a higher postion at the body member, the guiding surface of longitudinal guiding portion running from a position below a raised supporting edge for a curtain glider to a position above said raised supporting edge, a lower part of the guiding surface being located at a side of said raised edge facing away from the longitudinal slot and a higher part of the guiding surface having an extension extending over said raised edge.

13. Connector element according to claim 12, wherein the extension has, at least partly, a slope in the direction of the longitudinal slot between said raised edges.

14. Connector element according to claim 13, wherein the slope of the extension has a larger angle at ends of the extension then in a middle protion of the extension.

15. Connector element according to claim 12, wherein an outer shape of body member follows at least partly an outer shape of a said curtain rail.

* * * * *